United States Patent [19]

Bodolay

[11] 4,179,867

[45] Dec. 25, 1979

[54] PACKAGING MACHINE

[76] Inventor: William A. Bodolay, 5620 Live Oak Rd., Lakeland, Fla. 33803

[21] Appl. No.: 7,297

[22] Filed: Jan. 29, 1979

Related U.S. Application Data

[63] Continuation of Ser. No. 470,331, May 15, 1974, abandoned.

[51] Int. Cl.[2] ..... B65B 9/06

[52] U.S. Cl. ..... 53/568; 53/389; 226/53; 226/74

[58] Field of Search ..... 53/550, 551, 552, 553, 53/554, 568, 562, 389; 226/53, 74, 75, 108, 170, 172

[56] References Cited

U.S. PATENT DOCUMENTS

| | | | |
|---|---|---|---|
| 2,601,713 | 7/1952 | Nield | 226/53 X |
| 3,011,934 | 12/1961 | Borsak | 53/554 |
| 3,319,538 | 5/1967 | Bodolay et al. | 53/562 |
| 3,431,828 | 3/1969 | Crawford et al. | 53/507 |
| 3,517,479 | 6/1970 | Pinkham | 53/550 |
| 3,599,388 | 8/1971 | Feingold | 53/562 |

*Primary Examiner*—John Sipos

*Attorney, Agent, or Firm*—Duckworth, Hobby, Allen & Pettis

[57] ABSTRACT

A packaging machine for fabricating individual bag-like containers from a continuous web of polyethylene or like material comprising a frame having a substantially elongated configuration on which is mounted a plurality of work stations at least partially defining a flow path along which the web travels as it is being fabricated. A web carrier means in the form of one or more carrier belts supportingly engages said web by finger means to penetrate a predetermined portion of the web by virtue of the finger means being oriented to extend outwardly relative to the interior of the web. A drive assembly is interconnected in driving relation to the carrier means and serves to feed the web along said flow path and to a fill assembly whereby the web material passes into and out of said fill assembly in a predetermined manner to allow for an open orientation or configuration at the fill station to permit filling. Sealing means, carrier guide means and web attachment means are all mounted on the frame in spaced relation to one another at predetermined positions along the flow path to accomplish fabrication of the individual containers.

14 Claims, 13 Drawing Figures

FIG. 6
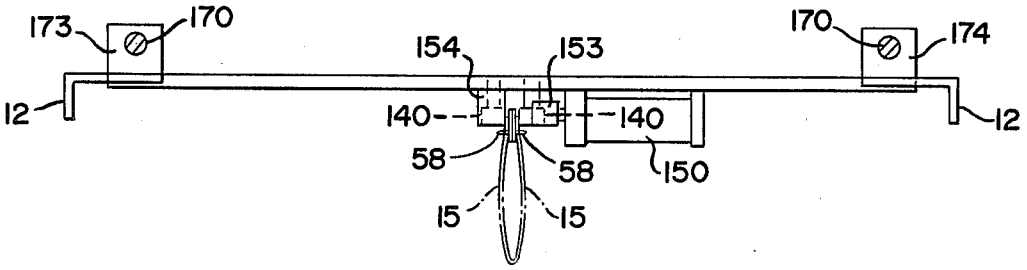
FIG. 7
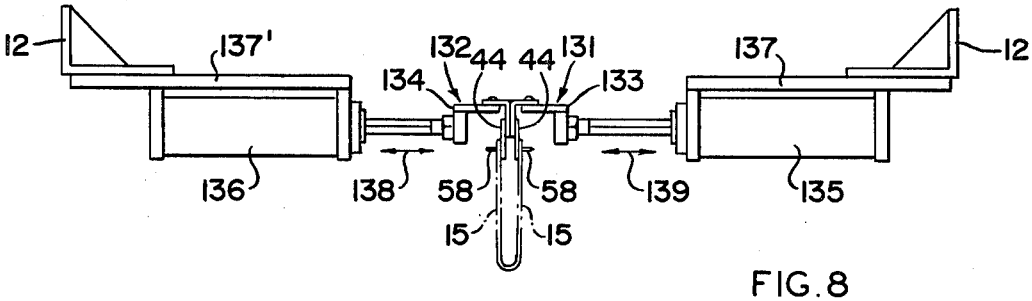
FIG. 8
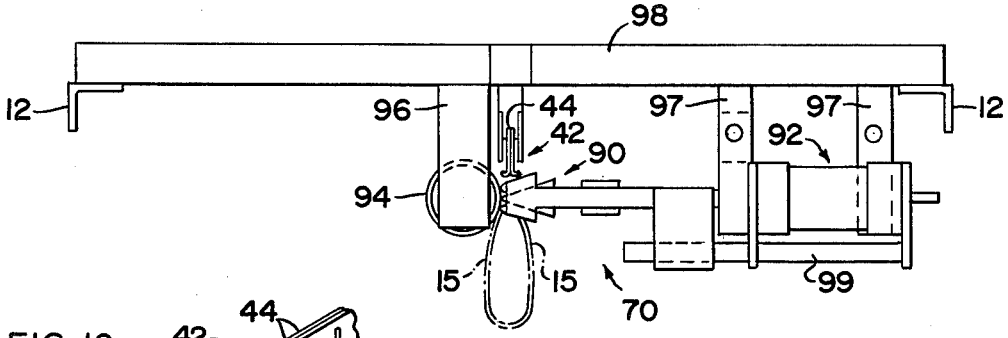
FIG. 10
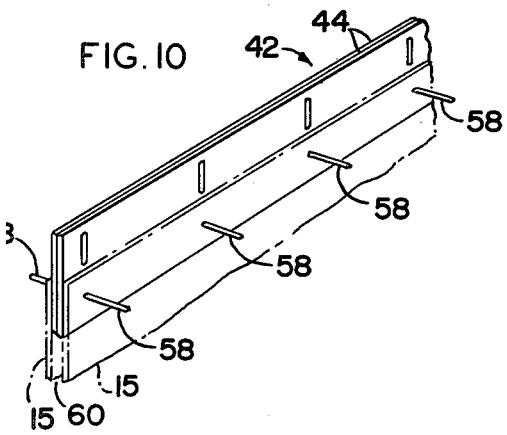
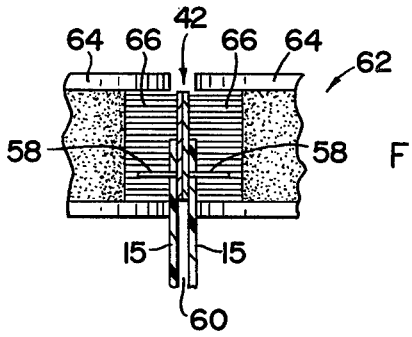
FIG. 9
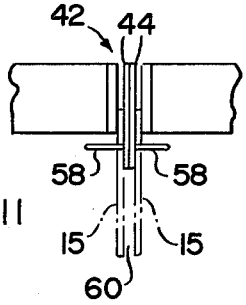
FIG. 11
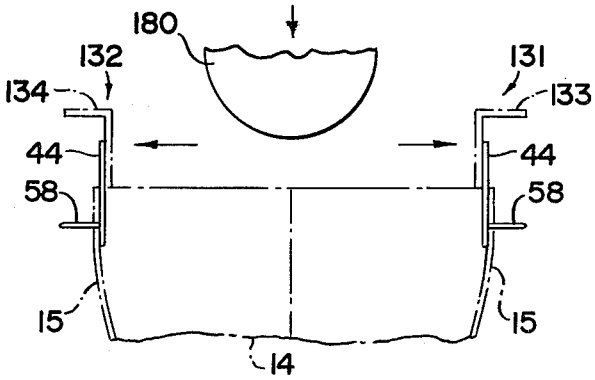
FIG. 12

PACKAGING MACHINE

This is a continuation, of application Ser. No. 470,331 filed May 15, 1974 now abandoned.

BACKGROUND OF THE INVENTION

1. Field of the Invention

This invention relates to a packaging machine of the type primarily designed to produce individual bag-like containers from a continuous web of any applicable material which is generally in the form of a flexible plastic; wherein fabrication is accomplished by directing the web along a predetermined flow path at least partially defined by a plurality of work stations arranged on said machine.

2. Description of the Prior Art

In the packaging industry there exists a wide variety of packaging machines which are both specifically and broadly designed to accomplish the efficient production of numerous types of packaging structures. The present invention is basically concerned with the type of packaging machine which is the subject of U.S. Pats. 2,877,609 and 3,462,913, both in the name of Bodolay, et al. Generally, the machines disclosed in these patents, and others existing in the prior art are directed to the production or fabrication of a plurality of bag-like containers on a substantially continuous basis from a continuous web of flexible or like, applicable material.

An investigation of the numerous designs of such machines previously or currently available or known reveals an attempt of those in the industry to produce a machine capable of versatility in the fabrication of the end product while at the same time providing for economical operation, maintenance and initial purchase of such machine.

One prior art machine is disclosed in U.S. Pat. 3,599,388 to Norman Feingold directed to a method and apparatus for forming and loading containers. A particular note is the method of transporting the web through the machine for fabrication. The structure and method utilized is a carrier device or belt 40 having a plurality of pins arranged thereon. In FIG. 3, Feingold specifically discloses these pins impaling a single thickness of the web. FIGS. 8-10 teach a single row of pins impaling a double thickness of the web from one side only. Because of this holding structure in both embodiments of Feingold the web is not supported by the pins in the area corresponding to the work station where the containers are filled. Further, it should be noted that, while the Feingold structure is certainly operational, it is representative of a number of other prior art devices which lacks the advantages of being effectively versatile due to its generally overly complex structure.

Similarly, the U.S. Pat. to Greenbaum, 3,739,522 is directed to the formation of manufacturing containers used in the packaging of plants and the like. As clearly shown in FIG. 3 of Greenbaum, a container or bubble 34 is formed by sequential operation of clamp devices which are operated by a timing mechanism. Again, it should be noted that while such devices are clearly functional, they suffer from inherent inaccuracies because of the difficulty in adequately regulating or controlling timing mechanisms of the type disclosed.

More specifically, packaging machines should have the versatility to produce containers of varying dimension, configuration and structural design without the need for complex, time consuming modification of the basic structural features of the machine. Ideally, packaging machines of this type should be capable of efficiently transporting the web to be processed along a flow path for exposure to various work stations in an efficient manner and in addition, accomplish the required steps of forming, sealing, opening and filling, closing and severing of predesigned web portions. Accordingly, the efficient and accurate production of containers of predetermined dimension and configuration having consistently high quality and the required, predetermined amount of durability and useful life is accomplished.

In an effort to accomplish such goals, numerous prior art machines have been designed to include overly complex structural features which necessarily add to the cost of maintenance, operation and initial purchase of the machine. In addition, a number of prior art machines are unnecessarily large and heavy resulting in difficulty in transporation from point of manufacture to point of use as well as relocation of such a machine within a plant where it is being operated.

Accordingly, it is readily seen that there is a need in the packaging industry for a packaging machine capable of efficiently and economically producing a plurality of containers on a substantially continuous basis, wherein the configuration, structural design and dimension of such containers may be easily varied through minor adjustments of the various structural elements comprising the fabricating means of such a machine. In addition, such a machine should be simple in design and structural configuration thereby reducing cost of purchase and maintenance.

SUMMARY OF THE INVENTION

This invention relates to a packaging machine designed to direct a substantially continuous web of polyethylene or like flexible, plastic material along a flow path of a machine wherein a plurality of working stations are arranged on the machine, in communicating relation to the web and in predetermined spaced relation to one another.

More specifically, a source of web material is mounted adjacent to or in communicating relation with the established flow path as it travels along the frame partially defining the machine. Web forming means is mounted on the frame and serves to properly shape or fold the web into a desired configuration. This configuration, ideally, and also dependent upon the containers being formed, is defined by the arrangement of two web portions positioned in opposed relation to one another. These opposed web portions define the oppositely disposed wall portions of the finished container. A web carrier means, which may be in the form of one or more carrier belt means is movably mounted on the frame and disposed to travel along at least a portion of the flow path of the web. Carrier finger means are connected to the carrier belt means and are disposed to extend outwardly from what may be termed the interior of the web. In this context, the interior of the web is defined by the space or area in between the oppositely disposed web portions.

A web attachment means in the form of one or more attachment heads forcibly engages both the carrier belt means and the web so as to force penetration of the web by the finger means causing the web to be impaled on the finger means and thereby be supported on the carrier belt means for transportation along the flow path of fabrication. As will be explained in greater detail hereinafter the attachment means comprises a bristle bearing portion such as a brush, or other material which is easily penetrable by the fingers. This allows a sufficient backing or support surface for the web as it forcibly engages the fingers thereby allowing sufficient resistance for penetration of the finger means through the web portion and also allows the finger means to penetrate into the bristle bearing portion of the attachment head itself.

Sealing means in the form of a plurality of sealing assemblies are movably mounted on the frame to operatively engage the web portion for the purpose of sealing the individual and oppositely disposed web portions together. The sealing heads of the sealing assemblies are so configured and activated that they may simultaneously form a seal between oppositely disposed web portions and sever or separate along the sealed area. This causes formation of either the various compartments or the individual containers depending upon the disposition of the sealing head relative to the web, web portion and flow path. The specific configuration or orientation of the seal is dependent upon the configuration and/or orientation of the sealing head and cooperating parts associated with each of the sealing assemblies. Each of the sealing assemblies may be heat activated. It should be noted, however, that the use of heating means for the sealing assemblies does not per se form part of the present invention and any applicable manner could be utilized or incorporated in the sealing assemblies to accomplish a seal. At least one of the sealing assemblies comprises a pivotally mounted seal head designed to move in a substantially planar path into and out of sealing engagement with one or more of the web portions. A seal is thereby created therebetween of a desired disposition and configuration dependent upon the dimension and configuration of the container being fabricated.

A drive assembly is mounted on the frame and interconnected to the carrier means to provide at least in part the driving force utilized in moving the carrier belt and the attached web along the predetermined flow path. The drive assembly comprises at least two drive belts disposed in substantially opposite, cooperating relation to one another. Both drive belts have a continuous, closed loop configuration and are mounted on opposite sides to the carrier belt and in engaging, driving relation thereto. Each of the driving belts are driven by respective drive heads which also form part of the drive assembly.

The drive assembly is operatively connected to an acutation means including at least one actuation element itself disposed on the frame or adjacent thereto. The actuation element is disposed to move in a predetermined path while at the same time maintain driving engagement with the drive assembly. A free wheeling clutch or like device is positioned in interconnecting relation between the actuation element and the drive assembly so that upon movement of the actuation element along its predetermined path, the drive assembly is activated to rotate the driving heads in a desired direction. It should be noted that because of the free wheeling clutch, the carrier belt is driven in a single direction and along the flow path in a desired direction.

Sensing means in the form of one or more switch elements are prepositioned relative to the actuation means so as to sense the orientation or relative disposition of the actuation element along its path of travel. These sensing means are in turn interconnected to the operative drive means of the actuation means itself, and a primary control means, which will be described in detail hereinafter. It is important to note that the term "operative drive means", utilized to describe the various drive means of the structural elements comprising the machine, is herein defined as the driving structures supplying moving force to each of the various structural elements described hereinafter. The term "operatively connected" is generally used in the sense that the various elements operatively connected to one another may be interconnected through common electrical circuitry which, per se, forms no part of the present invention but which accomplishes the interconnection and sequential or coordinated actuation of the various drive elements associated with each of the structural elements comprising selected structural elements of the machine.

The control means, referred to above, is of the type disclosed (FIG. 11) in U.S. Pat. No. 3,319,538 to Bodolay, et al. It should be noted that this type of control means, while explained in relative detail herein is representative of a general type of control means which could be incorporated into the packaging machine of the present invention. The control means per se forms no part of the present invention other than its relative operative interconnection between the operative drive assemblies of the structural elements comprising the packaging machine of the present invention. The control means is electrically interconnected to selectively, sequentially and concurrently activate the drive assemblies of the structural elements included in the fill assembly, the belt take up assemblies, and the actuation means. The specific operation and function of the control means relative to the other pertinent structural elements of the present invention will be described in detail during the detailed description of the operation of the present invention, hereinafter.

The sensing means is operatively connected to the operative drive means of the actuation means itself and the control means. Each one or more of the switch elements comprising the sensing means may be adjustably positioned relative to the actuation means and more specifically the actuation element. This allows for infinitely variable regulation of movement of the web carrier means and the attached web as well as selective operation of the various structural elements comprising the fill assembly. This is accomplished due to the fact that actuation of the various elements needed to accomplish proper transporting or location of the carrier belt and attached web is dependent in part upon a specific orientation and/or disposition of the actuation element along its path of travel which in turn is sensed by one or more of the switch element comprising the sensing means. It should be clear, therefore, that adjusting the position of the one or more switch elements relative to the actuation element causes a variation in movement of the carrier means and attached web. Similarly, the determination of the relative sequence of actuation of the various structural elements comprising the fill assembly, belt take up assembly and the actuation means itself is determined by the operative interconnection of the control means to the operative drive assemblies of these various parts of the subject machine. Regulation of the size and configuration of the containers formed is, of course, dependent upon the operation of the various structural elements or work elements of the machine and their sequence of operation as the web travels along the flow path. Interconnection of the control means with various structural elements of the machine establishes a precise and infinitely variable means of regulating the sequential and/or concurrent operation of these elements on the web without any primary reliance on a timing means per se.

The fill assembly comprises web positioning means in the form of a first and second clamp means wherein each of the clamp means are disposed on opposite sides or upstream and downstream respectively of a separator means. Each of the clamp means and the separator means are driven by fluid actuated piston and cylinder arrangements or any other applicable drive means capable of the desired, predetermined movement of each of the clamp means and the separator means. These fluid actuated piston and cylinder arrangements represent the operative drive means of the individual clamp means and the separator means respectively. As explained above, these operative drive means are operatively connected to the control means wherein coordinated, sequential activation and resulting movement of the clamp means and the separator means occurs to provide a predetermined orientation and/or disposition of the web relative to the fill means and particularly relative to the separator means in the area between the first and second clamp means. The term "fill assembly" is used for reference only to designate a portion of the machine, or more particularly, a work station at which the web portions defining the wall sections of the container being formed are open or separated to allow for the contents to be packaged, to pass into the interior of the bag between the separated wall portions. The filling mechanism itself used to actually deliver or transport the contents to be packaged to the separate web portions, may take a variety of forms and per se forms no part of the present invention. In operation, the web travels along the flow path receiving the fabricating processes intended to be performed by the various working stations. The control means include a primary cam shaft which, upon operation, serves to activate various switches which, in turn, activate proper electrical circuitry to sequentially and/or concurrently operate the drive assemblies of the structural elements as explained above. The operation of the machine will herein be described with reference to a complete cycle wherein the cycle begins with the separator means closing and concurrently the downstream clamp of the web positioning means opens. At this point the take up elements associated with the respective carrier belts are disposed into a high pressure mode wherein belt "take up" occurs thereby removing any slack in the belt from the area adjacent the fill assembly. Immediately thereafter, the upstream clamp of the web positioning means opens. The actuation element is driven along its path of travel thereby causing the drive assembly, through the free clutch means to rotate and further causing the carrier belt and attached web portions to move into the area of the fill assembly adjacent the separator means. In the meantime, the cam shaft of the primary control means has been stopped and restarted so as to allow for proper operation of the actuation means relative to the drive assembly. The downstream clamp is closed, allowing a "bubble" to form by the oppositely disposed wall portions of the web being spread apart due to their interaction with the separator heads or the separation means. At this point, the portion of the carrier belt downstream of the downstream clamp remains stationary. Therefore, the take up elements of the take up assembly must be moved to their low pressure mode in order to accommodate movement of the respective belt elements comprising the carrier belt downstream of the take up assembly and into the area adjacent the fill assembly. The seal assembly immediately downstream of the fill assembly is activated, causing separation of the formed and filled container from the flow path while the correspondingly positioned web adjacent this seal assembly is not moving. The actuation element of the actuation means begins its return travel after actuating proper sensing elements of the associated sensing means. Forward motion of the carrier belt and attached web immediately upstream of the fill assembly thereby stops and the upstream clamp closes. The seal assembly located upstream of the fill assembly provides the side seal and separation of the individual container wall portions. Finally, the control means is deactivated upon stopping of the primary drive shaft and the cycle is completed.

The invention accordingly comprises the features of construction, combination of elements and arrangement of parts which will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings in which:

FIG. 6 is a detailed end view of the web positioning means including at least one clamp means.

FIG. 7 is a detailed view of the separator means disposed at the fill assembly of the present invention.

FIG. 8 is a detailed view of another embodiment of a seal assembly comprising the seal means.

FIG. 9 is the attachment means of the present invention shown in interacting relation to the carrier means, finger means attached thereto and web attached thereon.

FIG. 10 is a detailed view of the web carrier with finger means attached thereto and web mounted thereon in supportive relation to the web carrier.

FIG. 11 is an end view of the embodiment shown in FIG. 10.

FIG. 12 is a detailed, substantially schematic view of the orientation of the carrier means, separator means and attached web prepared for filling of the contents being packaged.

Similar reference characters refer to similar parts throughout the several views of the drawings.

DETAILED DESCRIPTION OF THE PREFERRED EMBODIMENT

Figure 1:
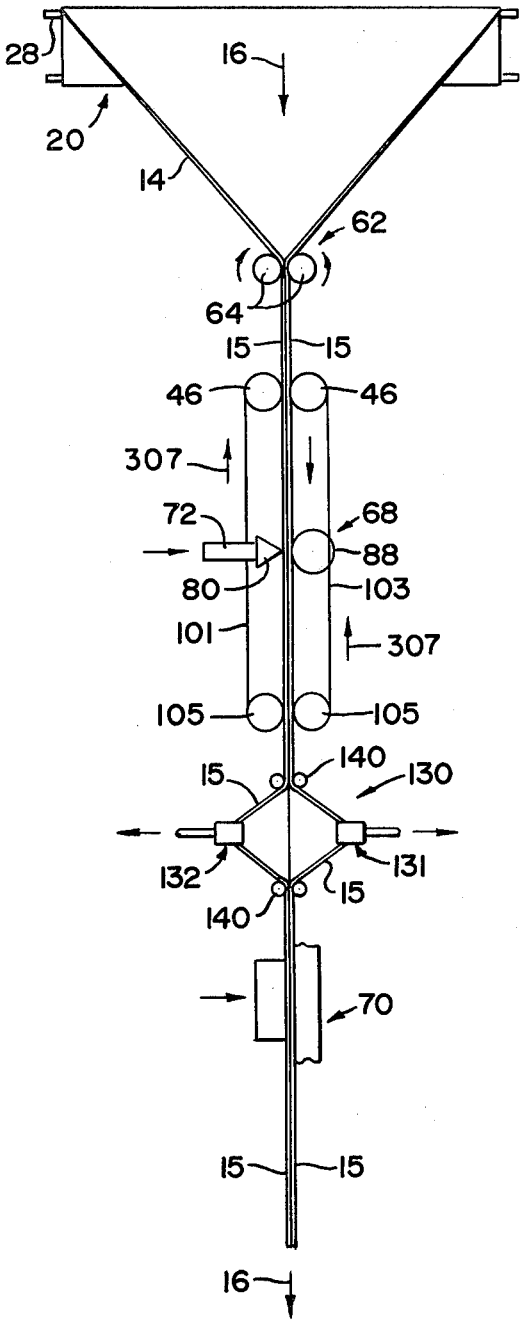
FIG. 1 is a top schematic view of the flow path of the web passing through the various work stations.

As shown primarily in FIGS. 2 and 3, the packaging machine of the present invention is generally indicated as 10 and comprises a frame 12 having a generally longitudinal configuration so as to at least partially define a flow path of fabrication of web material 14 as it passes a plurality of work stations (to be described hereinafter) mounted on frame 12. The flow path referred to is schematically represented in FIG. 1 wherein directional arrows 16 indicate the direction of travel of web 14 as it passes through the machine.

More specifically, a web source means generally indicated as 20 is mounted adjacent to, or in actual connection with frame 12 and in communicating relation therewith such that web 14 may be directed off of a supply roll 22 mounted on web source means 20 onto the frame 12 and into the flow path of fabrication. A feed bar 24 and a free floating or dancing arm means 26 serves to feed web 14 from supply roll 22 onto entrance bar 28 at least partially defining the beginning of the flow path of the web. Directional arrows 30 indicate the direction of travel of web 14 as it passes from supply roll 22 to the intake bar 28 which may be fixedly or rotatably mounted on frame 12. The free floating connection of dancing arm 26 to the web source means 20 serves to maintain adequate tension on web 14 as it is fed to the frame 12.

Web forming means generally indicated as 32 comprises a plurality of angularly oriented shaping elements 34 attached to the frame 12 and in particular to beam 36 in predetermined relation thereto and to each other so as to provide means to form or configure web 14 from a substantially flat planar configuration to a folded configuration wherein oppositely disposed web portions 15 are arranged in spaced, substantially parallel relation to one another (FIGS. 9, 10 and 11) along a major portion of the frame 12 and flow path defined thereon. Guide rollers 40 are provided on opposite sides of web 14 at the junction or point of conversion where the configuration of web 14 assume the folded configuration described above. Vertical guide rolls 40 are substantially elongated and dimensioned to extend at least a major portion of the length of web 40 as it passes through the machine.

The machine of the present invention further comprises a web attachment means shown in detail in FIG. 9 wherein the attachment means (FIG. 1) is generally indicated as 62 and comprises one or more attachment heads 64 rotatably mounted on frame 12. The attachment heads may be in the form of rotating wheels or rollers having finger penetrable material 66 formed thereon in movable engagement with the finger means 58, web 14 and carrier belt 44. As shown in FIG. 9, one embodiment of the present invention includes the attachment head 64 located on opposite sides of the individual web portions 15. The relative disposition of the attachment head 64 to the web portion 15 and the individual carrier belt 44 is such as to force the web 15 to be penetrated by the individual fingers 58 as they are forced into penetration with the material 66. This material may take the form of a brush comprising a plurality of closely arranged bristles sufficiently configured to allow penetration of the fingers 58 into the material 66. Alternately, the material 66 may be formed by any applicable material capable of allowing penetration of finger means 58 therein, through the associated or correspondingly positioned web portions 15. As clearly shown in both FIGS. 1 and 2, the attachment means comprising the oppositely disposed attachment heads are located at the juncture or approximate position where the web 14 changes its configuration into the parallel arranged, oppositely disposed web portions 15. Accordingly, the attachment means 62 may be mounted along the same rotational axis as vertical guide roller 40 as clearly shown in FIG. 3.

Figure 2:
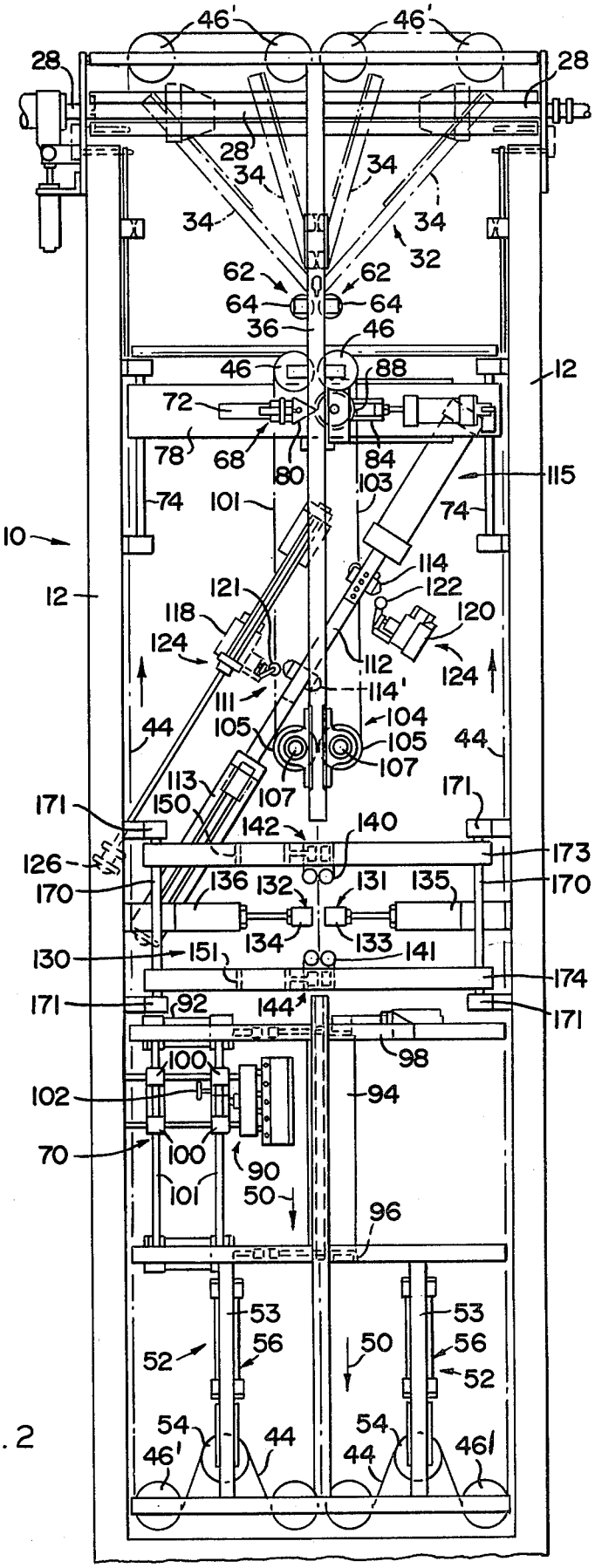
FIG. 2 is a top plan view of the support frame and structural elements defining the plurality of work stations disposed in spaced, predetermined relation to one another along the flow path defined by these work stations.
Figure 3:
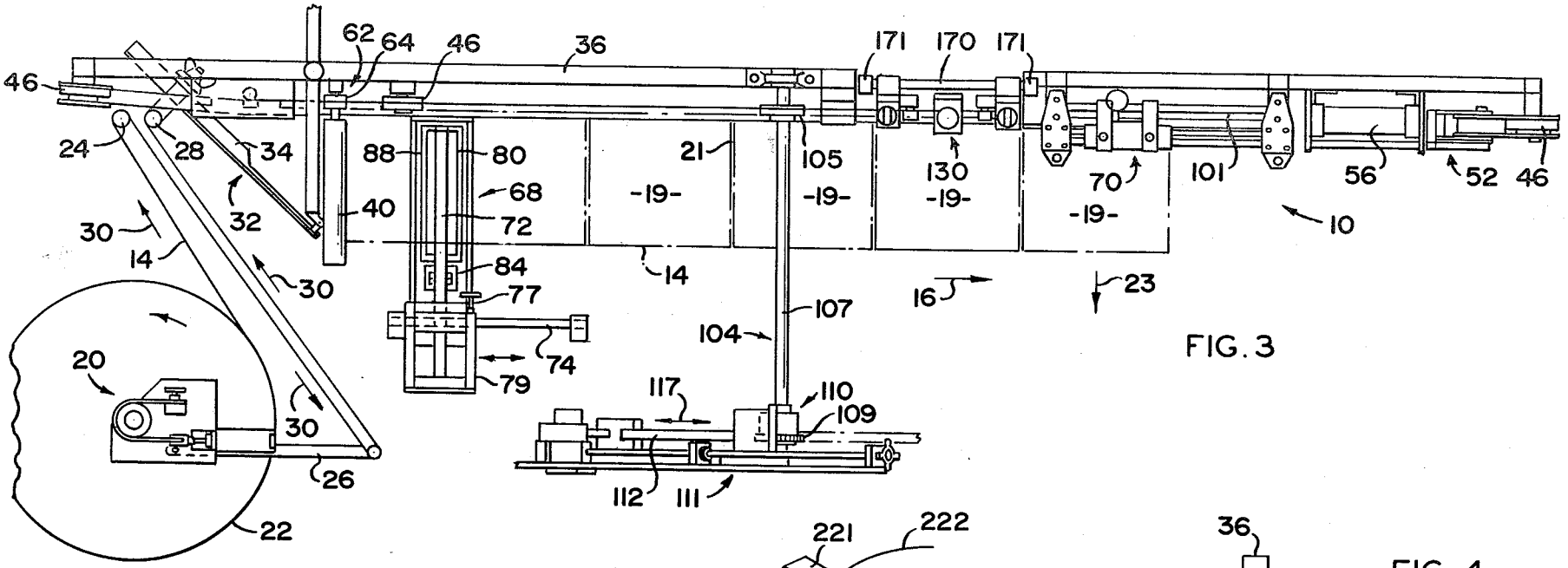
FIG. 3 is a side view showing the embodiment as basically represented in FIG. 1.

With reference to FIGS. 1, 2 and 3, the packaging machine comprises seal means including one or more seal assemblies generally indicated as 68 and 70, each of which are arranged in spaced, predetermined relation along frame 12 and in communicating relation with the web 14 as it travels along the flow path.

Figure 4:
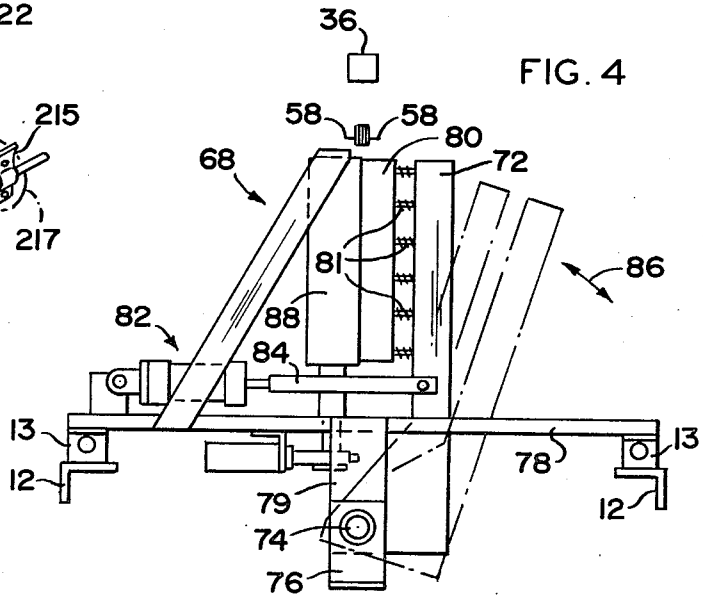
FIG. 4 is a detailed view showing structural features of a seal assembly.

One embodiment of the present invention comprises heat seal assembly 68 (FIG. 4) including a pivotally mounted sealing head 72 rotatably or pivotally attached at 74 to brace member 76 interconnected in rigid relationship to brace member 78. This heat assembly may be attached to frame 12 by appropriate brackets or connecting means 13. Heating element 80 is attached to head 72 by connectors and resistance elements 81. An operative drive element generally indicated as 82 comprises a combination, fluid activated piston and cylinder arrangement interconnected to linkage 84 which in turn is connected directly to head 72. Upon activation of operative drive element 82, the head 72 is caused to rotate in a substantially planar configuration in accordance with directional arrow 86. A sealing base 88 is positioned in corresponding relation with head 72 and heating element 80 wherein the base and the head are positioned on opposite sides of the flow path. Accordingly, activation of the drive element causes the head to move into and out of sealing engagement with the various web portions 15 comprising the web causing the formation of the various separator containers 19 along the seal and separation line 21 (FIG. 3). It should be noted that, while this specific embodiment discloses a heating element 80, other various types of sealing elements may be utilized without reliance specifically on the application of heat to accomplish the seal. As best shown in FIG. 3, the entire heating assembly 68 may be adjustably positioned along a predetermined length of the longitudinal axis of the flow path by moving the entire assembly along a mounting bar 74. Sufficient and/or conventional locking and manually adjustable means 77 is provided on the support frame 79 of heating assembly 68 and into locking engagement with the bar 74 so as to securely position the sealing assembly 68 along bar 74 as described. This, of course, allows for variation in container design and easy modification for changes in such variation.

As best shown in FIG. 8, one embodiment of the present invention comprises a sealing assembly 70 including a reciprocally mounted heating head 90 interconnected to an operative drive element 92 also comprising a combination cylinder and piston mechanism which is fluid actuated to cause movement of head 90 into and out of sealing engagement with web 14 in the manner described above with reference to heating assembly 68. A base means 94 is mounted in corresponding and cooperative relation to head 90 so as to provide proper support and backing therefor. Adequate brace means 96, 97, 98 and 99 are provided to supply proper support to the various elements described which comprise the sealing assembly 70. The sealing assembly 70 also serves as a severing means whereby application of heat or any other selected and applicable type of energy is applied to the web portions 15 located between sealing head 90 and base 94 so as to cause actual severing or separation of the web portions defining the containers 19. Discharge of the containers thereby occurs as indicated by directional arrow 23 (FIG. 3).

Similarly, heat assembly 70 is adjustably mounted to be positioned at various points along a predetermined length of the flow path. This is accomplished by adjustably mounting head 90 on support means 100 which in turn slidingly engages support bars 101. A conventional lock and/or adjustment means 102 is provided in locking interconnecting relation between the support means 100 and at least one of the support bars 101. By virtue of this arrangement, the head 90 can be located at any point along the longitudinal axis covered by the sealing assembly 70.

Figure 5:
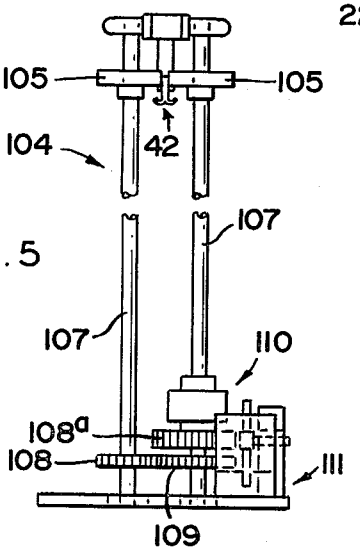
FIG. 5 is a detailed view of the drive assembly including connection to the actuation means as described.

The drive assembly is generally represented as 104 in FIGS. 2, 3 and 5 and comprises one or more drive elements 105 located in spaced, cooperating relation on opposite sides of carrier belt means 42. As best shown in FIGS. 1 and 2, the drive assembly further comprises drive belts 101 and 103 each being oppositely disposed and having a closed, continuous loop configuration. Belts 101 and 103 are driven by respectively positioned driving heads 105 in the directions indicated by directional arrows 307. These drive belts serve to guide and simultaneously drive the belt elements 44 in that they frictionally engage and are disposed on opposite sides thereof. Each of the drive heads 105 are attached to a drive shaft 107 which operatively engage one another by intermeshing gears 108 and 109. A free wheeling clutch or like device is attached to at least one of the drive shafts 107 to provide rotation of drive shaft 107 in a single direction only, as will be explained in detail hereinafter. Actuation means 111 is generally indicated in FIGS. 2, 3 and 5, and comprises an acutation element 112 arranged in driving engagement with the drive assembly 104 and more particularly, in intermeshing relation with pinion gear 108*a*. This actuation element 112 can take the form of a conventional rack so as to define a substantially rack and pinion assembly comprising the actuation element 112 (rack) and pinion gear element 108*a*. The actuation element 112 is movably mounted on support means 113 and disposed thereon relative to the drive assembly 104 and the frame 12 to move in a predetermined path of travel indicated by the various positions of stop member 114 fixedly attached to element 112. This single element 114 is represented in broken lines as a possible position by 114' and in full view in actual position as 114. The reciprocating movement of actuating element 112 and accordingly the reciprocating disposition of stop member 114 along its path of travel is caused by operative drive element for the acutation means generally indicated as 115. This drive element also may comprise a combination piston and cylinder arrangement which is fluid actuated to force movement of the actuation element 112 and the stop element 114 along its path of travel. By virtue of the interconnection and relative disposition of the free wheeling clutch 110 between shaft 107 and the point of driving engagement between gear 108*a* and actuation element 112, the gear 108*a*, and accordingly shaft 107 and driving heads 105 are caused to rotate in a single direction even though actual moving engagement occurs between gear 108*a* and actuation element 112 as element 112 reciprocates in both directions as indicated by arrow 117.

A sensing means including sensing switch elements 118 and 120 are disposed in cooperative relation with the path of travel of element 112 and element 112 itself. More particularly, the embodiments of switch elements 118 and 120 are, in this disclosure, shown as contact elements wherein contact arms 121 and 122 associated with switch elements 118 and 120 respectively actually engage and accordingly are tripped by stop member 114. Mounting means for the switch elements 124 comprise an elongated rod, and an adjustment means 126 whereby the disposition of switching element 118 may be positioned along the length of rod 124 so as to vary its point of engagement and accordingly point of actuation with the stop element 114.

Figure 13:
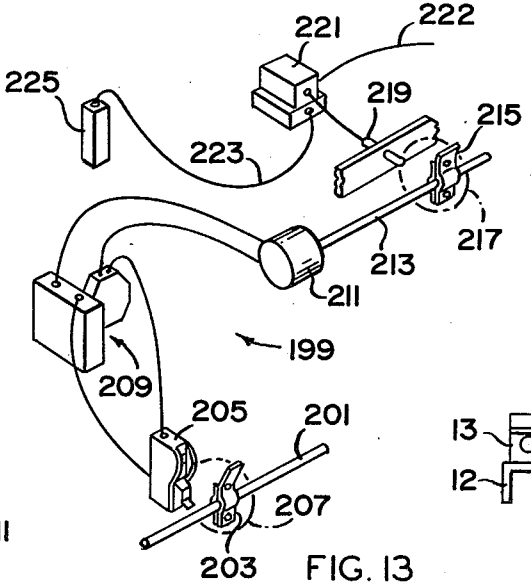
FIG. 13 is a schematic representation of a control means applicable for use in the present invention.

As stated above, the various sensing elements 118 and 120 of the sensing means along with the various actuating elements and assemblies of the structural components of the packaging machine are interconnected to a primary control means (FIG. 13) which serves to provide selective, sequential and/or concurrent actuation of the various structural components of the machine through mechanics, or fluidic or electrical circuitry. FIG. 13 represents a schematic view or representation of the control means applicable for the subject packaging machine. However, the present invention is not restricted to the use of this precise schematically represented control means. The control means comprises a primary cam shaft 201 having attached thereto an actuating cam means 203. When shaft 201 rotates, the end of cam means 203 trips actuating switch 205 as it makes contact along the line shown in FIG. 13 and represented as 207. As soon as switch 205 is actuated, the relay means 209 is energized and closes an electrical circuit to a cam shaft motor 211. This motor commences to operate and rotates the shaft 213 which may be referred to as a driving element actuator shaft. An actuator element cam 215 is mounted on shaft 213 and similarly rotates in a circular configuration represented by 217. When cam 215 contacts poppet valve 219, the valve member 221 then opens. Fluid or air passes from the supply line 222 through line 223 to the particular driving element associated with one or more of the various components comprising the machine. Each of these components is represented as element 225. Therefore, the various elements can be actuated as programmed dependent upon the disposition, number, configuration and/or placement of cams 203 and 215 relative to primary cam shaft 201 and drive shaft 213.

The web 14 is transported along the flow path by a web carrier means shown in detail in FIGS. 1, 2, 9, 10 and 11 and generally represented as 42. More particularly, the web carrier means comprises carrier belt means including a plurality of carrier belts 44 movably mounted on frame 12 by virtue of the carrier means 42 being movably driven by carrier belts 101 and 103 connected to guide wheels or rollers 46 idlers 46' and drive belts 105. In one embodiment of the present invention, the carrier belt means comprises two carrier belt elements 44, each having a closed loop or continuous configuration and mounted on the frame 12 to travel in a continuous fashion about opposite longitudinal sides of frame 12 as indicated by directional arrows 50. As described above, the disposition of the flow path of fabrication of web 14 essentially is down the center of frame 12 extending along its longitudinal axis. It should be noted, however, that the precise disposition of the flow path relative to frame 12 is dependent upon the predetermined placement of the various work stations necessary for fabrication. It is not a requirement that the flow path be in any given disposition relative to the frame or that the flow path have a linear configuration as that disclosed in FIGS. 1 and 2.

As best shown in FIG. 2, belt take up assemblies generally indicated as 52 are mounted on frame 12 by means of brace members 53 and include contact heads or rollers 54 movably engaging each of the individual belt elements 15. Take up elements 54 are reciprocally mounted on frame 12 relative to brace 53 by virtue of being attached to a belt take up operative drive assembly 56 which may comprise a fluid actuated piston and cylinder arrangement. Upon automatic actuation, due to its electrical interconnection with the primary control means 199, the operative drive means 56 are activated to dispose take-up elements 54 into either a high-pressure mode or lower pressure mode relative to the established flow path of individual belts 15. The high pressure mode of the respective take up elements is defined by a retracted position of the piston and cylinder assemblies wherein the respective belt elements are "taken up". This, as will be explained in detail hereinafter causes any "slack" to be removed from the area of the fill assembly. The low pressure mode of the take up element is defined by the piston and cylinder assemblies being in their extended position whereby travel of the belt elements 15 is allowed to continue downstream of the take up assemblies in allowing for the separation of the web portions by separator heads 131 and 132 in the area of the fill assembly.

As best shown in FIGS. 9, 10 and 11, carrier finger means are mounted on the web carrier means and more particularly on each of the belt elements 44. These finger means includes spaced apart fingers formed from a metallic or sufficiently rigid material to allow penetration of the individual fingers 58 into a predetermined portion of each of the web portions 15 associated with each of the individual belts 44 with the belts 44 being supported above their fingers 59 by rollers 46 and 46'. It should be particularly noted that the individual fingers 58 are mounted on the web carrier 42 and particularly the individual belt elements 44 in such a manner as to be oriented to extend outwardly from the interior of web 42. This interior is indicated in FIGS. 9, 10 and 11 as 60 and is defined by the space between the individual web portions 15.

The fill assembly of the present invention is generally indicated as 130 and is clearly shown in FIGS. 1, 2, 3, 6 and 7. More particularly, the fill assembly comprises a separator means including separator arms 131 and 132 located on opposite sides of the flow path and the web passing in said flow path. These arms include grab members 133 and 134 respectively drivingly attached to piston and cylinder arrangements 135 and 136 which themselves define the operative drive element for the separator means. These operative drive elements 135 and 136 are securely and supportedly mounted on brace elements 137 and 137' respectively which are, in turn, fixedly attached to frame 12. Activation of the operative drive elements 134 and 135 cause reciprocal movement as indicated by directional arrows 138 and 139, of the grab elements 133 and 134.

The fill assembly further comprises web positioning means including guide rollers 140 and 141 associated with clamp assembly generally indicated as 142 and 144 adjustably disposed on opposite sides of the separator means. Clamp assemblies may be further referred to hereby as upstream and downstream clamp assemblies. Each of the clamp assemblies is operated by an operative drive element comprising a combination cylinder and piston assembly which is fluid activated and generally indicated as 150 and 151 respectively. In operation, activation of the drive elements 150 and 151 causes clamping head 153 to move into secured engagement with the web 14 passing along the flow path between head 153 and clamp base 154. The structure shown in detail in FIG. 6 represents the clamp assembly 142, but it should be noted that this clamp assembly is essentially identical to the clamp assembly generally represented as 144 and accordingly, for the sake of clarity, both clamp structures will not be described in detail. It should further be noted that both of the clamp assemblies 142 and 144 are adjustably positionable relative to the flow path and the separator means along support bars 170 attached to frame 12 by means of mounting brackets 171. Brace means 173 and 174 interconnect respective clamp assemblies 142 and 144 to the bars 170. Again, the adjusted disposition of the clamp assemblies relative to one another and to the separator means defines the configuration or opening caused by the web to allow filling of an object 180.

It will thus be seen that the objects set forth above, among those made apparent from the preceding description, are efficiently attained, and since certain changes may be made in carrying out the above method and article without departing from the scope of the invention, it is intended that all matter contained in the above description shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A packaging machine of the type primarily designed to form containers from a folded web of material having an interior defined by opposing folded web portions, said machine comprising: frame means configured to define a flow path of travel and said web, web carrier means movably mounted on said frame and connected to said web along at least a portion of said flow path, said web carrier means at least partially disposed in supporting engagement with said web on the interior thereof, whereby fabrication of said web is performed as it travels along said flow path, said web carrier means including carrier belt means comprising at least two carrier belt elements, each of said carrier belt elements is mounted on the interior of opposite portions of said web, finger means affixed to the exterior surface of each of said carrier belt elements, said finger means of each of said carrier belt elements disposed in penetrating, supporting relation to the correspondingly positioned wall portions and outwardly from the interior of said wall portions, each of said carrier belt elements including a substantially continuous closed loop configuration, each of said carrier belt elements exposed to orient at least a portion of said closed loop configuration to travel along said flow path in substantially parallel relation to one another and in direct supporting engagement relative to said web.

2. A packaging machine of the type primarily designed to form containers from a folded web of material having an interior defined by opposing folded web portions, said machine comprising: frame means configured to define a flow path of travel of said web, web carrier means movably mounted on said frame and connected to said web along at least a portion of said flow path, said web carrier means at least partially disposed in supporting engagement with said web on the interior thereof, whereby fabrication of said web is performed as it travels along said flow path, said web carrier means including carrier belt means comprising at least two carrier belt elements, each of said carrier belt elements is mounted on the interior of opposite portions of said web, finger means affixed to the exterior surface of each of said carrier belt elements, said finger means of each of said carrier belt elements disposed in penetrating, supporting relation to the correspondingly positioned wall portions and outwardly from the interior of said wall portions, each of said carrier belt elements including a substantially continuous closed loop configuration, each of said carrier belt elements disposed to orient at least a portion of said closed loop configuration to travel along said flow path in substantially parallel relation to one another and in direct supporting engagement relative to said web, and belt take-up means movably connected to said carrier belt means in carrier belt position regulating relation thereto, whereby travel of said carrier belt means is regulatable along said flow path.

3. A packaging machine as in claim 2, further comprising a fill assembly including at least one separator arm movably mounted on said packaging machine and disposable into and out of said flow path, said one separator arm mounted in movable engagement with one of said carrier belt elements and the web portion attached thereto outwardly from the direction of said flow path, whereby the degree of outward displacement defines at least in part the dimension of the formed container and said web is held in continuously supported relation to said carrier belt elements throughout the filling operation.

4. A packaging machine as in claim 2, wherein each of said finger means are disposed to extend outwardly from each of said respective carrier belt elements relative to said web interior and through oppositely disposed wall portion of said web in penetrating relation thereto and in supporting engagement therewith.

5. A packaging machine as in claim 4, further comprising a fill assembly comprising at least two separator arms movably mounted on said packaging machine in substantially transverse relation to the direction of travel of said web along said flow path, each of said separator arms mounted in movable engagement with respect to said carrier belt elements and movable to displace both said carrier belt elements and the web wall portions thereon outwardly substantially transverse to the direction of the flow path, whereby the degree of outward displacement defines at least in part the dimension of the formed container and said web is held in continuously supported relation to said carrier belt elements throughout the filling operation.

6. A packaging machine as in claim 5, wherein said belt take-up means include biasing means interconnected to said carrier belt means so as to normally bias each of said carrier belt elements into substantially parallel relation to one another when disposed along said flow path.

7. A packaging machine as in claim 2, wherein said belt take-up means is movably positionable relative to said belt between a high pressure mode and a low pressure mode, each of said high pressure and low pressure modes at least partially defining preselected movement of said carrier belt means along said flow path.

8. A packaging machine as in claim 7, wherein said high pressure mode is defined by disposition of said take-up belt means in a carrier belt retracted position, whereby a portion of said carrier belt means is directed substantially out of said flow path.

9. A packaging machine as in claim 7, wherein said low pressure mode is defined by disposition of said take-up belt means in a carrier belt extended position, whereby a portion of said carrier belt means is directed substantially into said flow path.

10. A packaging machine as in claim 2, further comprising web attachment means mounted on said frame contiguous to said flow path, said web attachment means disposed in movable engagement with at least said carrier belt means, said attachment means disposed relative to the flow path of said web and said carrier belt means to forcibly engage said web and said carrier belt means.

11. A packaging machine as in claim 10, wherein said web attachment means includes finger penetrable material disposed thereon, each of said attachment means, said web and said carrier belt means relatively disposed to force penetration of said finger means into said attachment means through said web.

12. A packaging machine as in claim 11, wherein said web attachment means is attached to said frame at the junction of said web and said carrier belt means.

13. A packaging machine as in claim 2, further comprising attachment means including at least two attachment heads, each including finger penetrable material disposed thereon, said attachment heads positioned on opposite sides of said belt elements and web portions attached thereto, each of said attachment heads disposed to forcibly engage correspondingly positioned belt elements and said associated web, said finger means oriented to penetrate said web upon interaction of said web and said finger means with said attachment means.

14. A packaging machine as in claim 13, wherein said attachment heads comprise bristle bearing members rotationally mounted on said frame in engagement with said belt element associated therewith, said bristle bearing members disposed in cooperative relation to said finger means so as to cause penetration of said bristle means by said finger means through said associated web portion.

* * * * *

UNITED STATES PATENT AND TRADEMARK OFFICE

CERTIFICATE OF CORRECTION

PATENT NO. : 4,179,867

DATED : December 25, 1979

INVENTOR(S) : William A. Bodolay

It is certified that error appears in the above-identified patent and that said Letters Patent are hereby corrected as shown below:

Claim 1, line 39, delete "and" and insert therefor--of--.

Signed and Sealed this

*First* Day of *April 1980*

[SEAL]

*Attest:*

SIDNEY A. DIAMOND

*Attesting Officer*

*Commissioner of Patents and Trademarks*